US007356465B2

(12) United States Patent
Tsingos et al.

(10) Patent No.: US 7,356,465 B2
(45) Date of Patent: Apr. 8, 2008

(54) PERFECTED DEVICE AND METHOD FOR THE SPATIALIZATION OF SOUND

(75) Inventors: Nicolas Tsingos, Antibes (FR); Emmanuel Gallo, Nice (FR); George Drettakis, Nice (FR)

(73) Assignee: Inria Institut National de Recherche en Informatique et en Automatique, Le Chesnais Cedex (FR)

( * ) Notice: Subject to any disclaimer, the term of this patent is extended or adjusted under 35 U.S.C. 154(b) by 801 days.

(21) Appl. No.: 10/748,125

(22) Filed: Dec. 31, 2003

(65) Prior Publication Data

US 2005/0114121 A1 May 26, 2005

(30) Foreign Application Priority Data

Nov. 26, 2003 (FR) ..... 03 13875

(51) Int. Cl.
*G10L 19/04* (2006.01)

(52) U.S. Cl. ..... 704/220; 704/278; 704/203; 84/633; 84/626

(58) Field of Classification Search ..... 704/200, 704/205, 204, 206, 278, 220; 84/633, 626
See application file for complete search history.

(56) References Cited

U.S. PATENT DOCUMENTS 5,977,471 A * 11/1999 Rosenzweig ..... 84/633

* cited by examiner

*Primary Examiner*—Huyen X. Vo
(74) *Attorney, Agent, or Firm*—Foley & Lardner LLP

(57) ABSTRACT

The invention relates to a computer device comprising a memory 108 for storing audio signals 114, in part pre-recorded, each corresponding to a defined source, by means of spatial position data 116, and a processing module 110 for processing these audio signals in real time as a function of the spatial position data. The processing module 110 allows for the instantaneous power level parameters to be calculated on the basis of audio signals 114, the corresponding sources being defined by instantaneous power level parameters. The processing module 110 comprises a selection module 120 for regrouping certain of the audio signals into a variable number of audio signal groups, and the processing module 110 is capable of calculating spatial position data which is representative of a group of audio signals as a function of the spatial position data 116 and instantaneous power level parameters for each corresponding source.

26 Claims, 6 Drawing Sheets

Fig.6
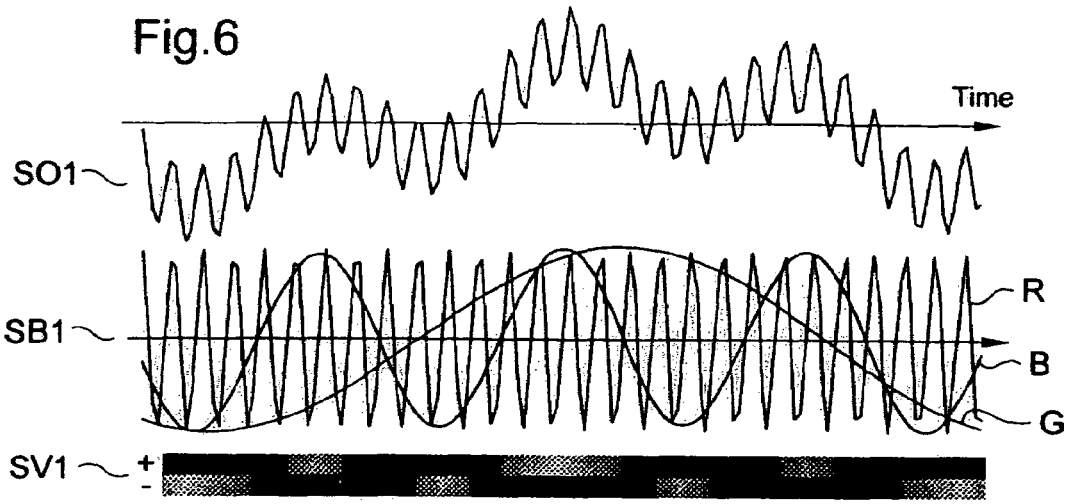
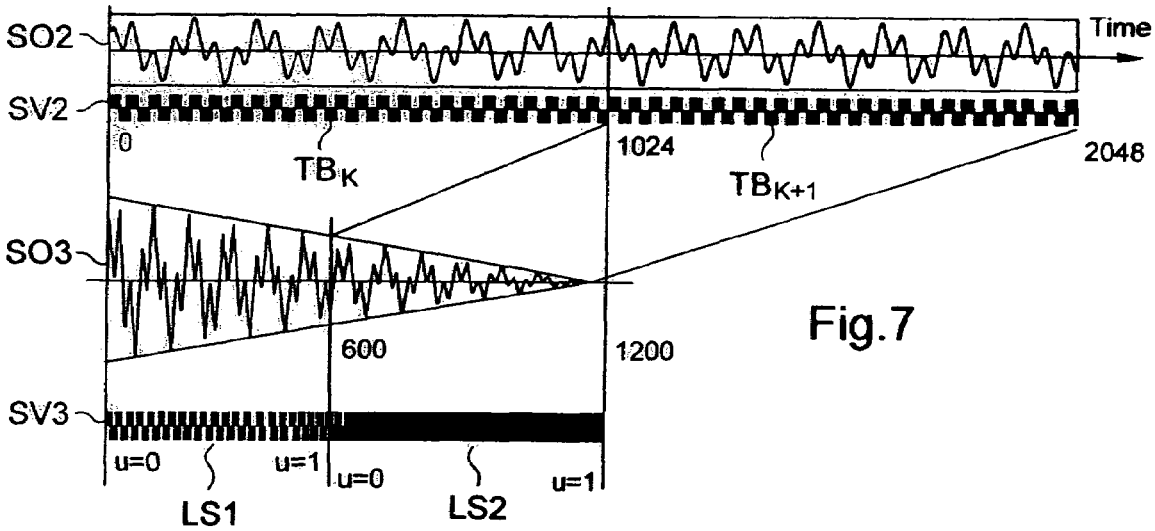
Fig.7
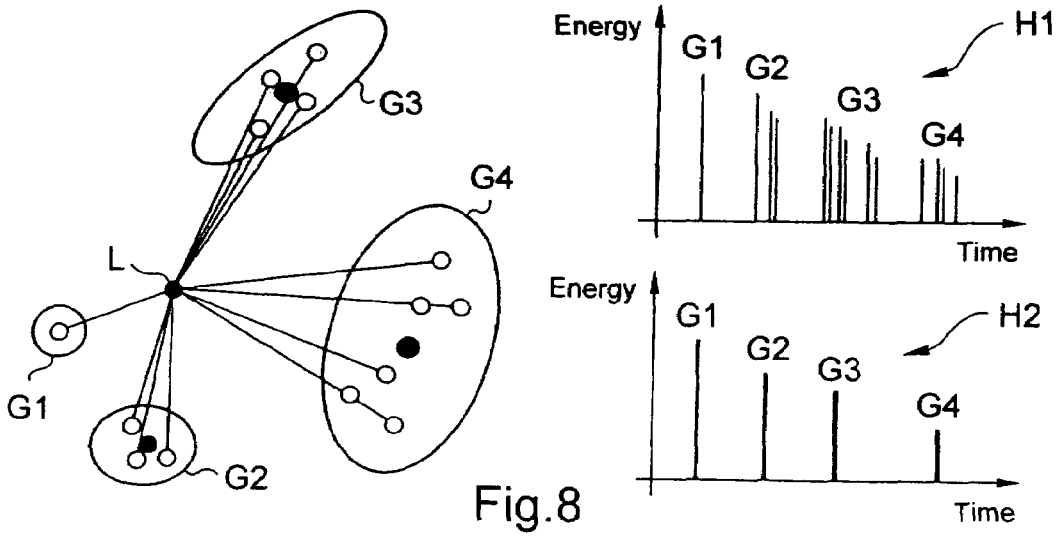
Fig.8

PERFECTED DEVICE AND METHOD FOR THE SPATIALIZATION OF SOUND

FIELD OF THE INVENTION

The invention relates to the sector of sound processing.

BACKGROUND OF THE INVENTION

The prior art of the processing of sound allows for the addition to the presentation of a scene, in particular in 3D on a screen, of a spatialized sound in such a way as to improve significantly for the viewer the realism and the sense of immersion in the scene. This technique is appropriate for processing in real time of a limited number of sound sources in the scene.

Scenes, in particular virtual scenes, are becoming more and more complex; in other words, the number of sound sources in a scene is increasing. Accordingly, processing these numerous sound sources in real time, and producing a spatialized sound output for this large number of sound sources is often impossible because of the high cost of processing the signal.

The invention seeks to improve the situation.

The invention relates to a computer device comprising a memory unit capable of storing audio signals, in part pre-recorded, each corresponding to a source defined by the spatial position data, and a processing module for processing these audio signals in real time as a function of the spatial position data.

According to a principal characteristic of the invention, the processing module is capable of calculating the parameters of the instantaneous power level on the basis of the audio signals, the corresponding sources being defined by the said instantaneous power level parameters, the processing module comprising a selection module capable of regrouping a certain number of the audio signals in a variable number of audio signal groups, and the processing module is capable of calculating the representative spatial position data of a group of audio signals as a function of the spatial position data and the parameters of the instantaneous power levels from each corresponding source.

The computer device according to the invention may comprise a large number of additional characteristics, which can be taken separately and/or in combination:

The selection module is capable, prior to the formation of the groups of audio signals, of selecting the inaudible audio signals as a function of the parameters of the instantaneous power levels, comprising a power level and a masking threshold for each source, and of preserving only the audible audio signals;

The power level parameters are calculated for each source on the basis of the spectral density of the instantaneous power, calculated beforehand on the basis of the audio signals in part pre-recorded;

The processing module is capable of processing each group of audio signals into one pre-mixing audio signal and of reassembling the pre-mixing audio signals in order to obtain one mixing signal which is audible to the listener;

The processing module comprises a video processor which is capable of transforming the group of audio signals into a group of textured video signals, of processing each textured video signal from the group according to the sound modification parameters, and of reassembling and transforming the signals into one pre-mixing audio signal;

The modification parameters of the sound comprise one sound attenuation parameter and/or one sound propagation delay parameter;

The selection module is capable of forming, on the basis of a first group of audio signals and calculated data relating to the spatial position of the group, two groups of audio signals, and of calculating the spatial position data of a representative from each of these two groups;

The selection module is capable of determining, on the basis of the first group of audio signals, their corresponding sources, and the calculated data for the spatial position of the representative of the first group, a source for which the sum of the calculated error distances between the spatial position of this source, and those of other sources from the group, is minimal, and is capable of attributing the audio signals of the first group and their corresponding sources to one of the spatial positions among the calculated data for the spatial position of the representative of the first group and the spatial position data of the determined source, as a function of the evaluations of the error distance, in such a way as to form two groups;

The selection module is capable of carrying out an error distance evaluation for an audio signal of the first group and its corresponding source, consisting of evaluating, on the one hand, a part of the error distance between the spatial position data of this source and the calculated spatial position data of the representative of the first group and, on the other, the error distance between the spatial position data of this source and the spatial position data of the determined source, then of evaluating the minimum error distance between the two, and the selection module being capable of attributing the audio signal and its corresponding source to the spatial position data of the determined source or of the representative of the first group corresponding to the minimum distance error;

The spatial position data of the determined source corresponds to the spatial position data of the representative of a second group;

The selection module is capable of calculating the spatial position data of each representative of the group as a function of the power level parameters of each source attributed to the group;

The selection module is capable of recalculating the spatial position data of the representative of each of the two groups, by determining a source for which the sum of the error distances between the spatial position of this source and those of the other sources of the group is minimum, and the selection module is also capable of re-attributing the sources to one or another of the representatives of one of the two groups as a function of the said evaluation of the minimum error distance;

The selection module is capable of recalculating the spatial position data of the representative of each of the two groups, and of re-attributing the sources to one or another of the representatives of one of the two groups until the sum of the error distances between the representatives of the two groups and their sources reaches a minimum;

The selection module is capable of dividing a group until a predetermined number of groups is obtained or until the sum of the error distances between the representatives of the groups and their sources reach a predetermined threshold.

The invention likewise relates to a method of processing audio signals in part pre-recorded, each corresponding to one source, comprising the stages consisting of:

a. Calculating the instantaneous power level parameters on the basis of audio signals, the corresponding sources being defined by these parameters and by the spatial position data;

b. Regrouping certain of the audio signals into a variable number of audio signal groups and calculating the spatial position data representative of each group of audio signals as a function of the spatial position data and the instantaneous power level parameters of each corresponding source;

c. Processing these audio signals per group, in real time, as a function of the spatial position data representative of the group.

Other characteristics and advantages of the invention can be derived from an examination of the detailed description hereinafter, as well as from the appended drawings.

BRIEF DESCRIPTION OF THE DRAWINGS

FIG. 6 shows the processing of an audio signal in the form of a video signal by a 3D graphic processor;

FIG. 7 shows the processing of a signal into a temporally compressed and attenuated signal; and FIG. 8 shows, for a configuration of four groups of sources, two echograms of pre-mixing signals from each group, obtained differently.

Appendix 1 shows the mathematical formulae used for the realisation of the invention. Appendix 2 shows the different variables used and their significance.

The drawings and appendices essentially contain the key elements. They can therefore serve not only to provide a better understanding of the description, but also contribute to the definition of the invention, as applicable.

DESCRIPTION OF THE PREFERRED EMBODIMENT

Figure 1:
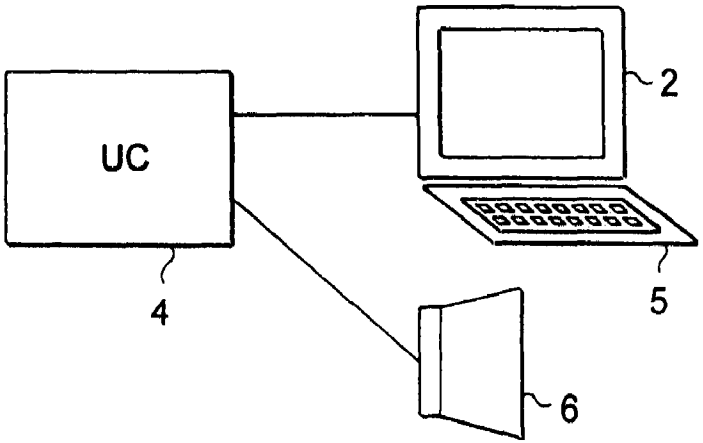
FIG. 1 represents a computer device according to the invention.

FIG. 1 represents a computer device comprising a central unit 4 connected to a number of peripherals such as a screen 2, a keyboard 5, a mouse, a loudspeaker device 6, and others. This computer device is used for the dynamic visual display on-screen of an environment (also referred to as the "scene"), defining different sound sources and for the restitution by loudspeaker of the sounds incurred by the latter. The central unit therefore comprises different hardware components capable of processing the audio signals as described in reference to FIG. 2.

The method is known of using an audio processor (or processing module) connected to a memory 8 and to a loudspeaker device 28. The audio processor 10 can form part of a sound card and is therefore referred to as a DSP ("Digital Signal Processor"). The audio processor receives the digital signals deriving from the processor of the mother board, and converts them into analogue signals, transformed by loudspeakers into sounds. High-performance DSP processors allow for digital signals to be processed by adding signal distortions, echoes (referred to as "reverberations") for example. Certain mother boards do themselves have a sound card integrated in them, which is fitted with a DSP processor. Accordingly, in the case of FIG. 2, the audio processor operates with audio signal data 14 and with spatial position data of a user (also referred to as "listener" or "viewer") in relation to the scene and the sound sources 16 recorded in memory 8. The audio signals are each emitted by a sound source having a spatial position defined in a scene or environment presented on the screen. In a known manner, a spatial position can be represented in the memory by a set of three Cartesian, polar, or other co-ordinates. The definition of the spatial position of a given listener likewise allows for an audio return to be obtained for the latter.

Figure 2:
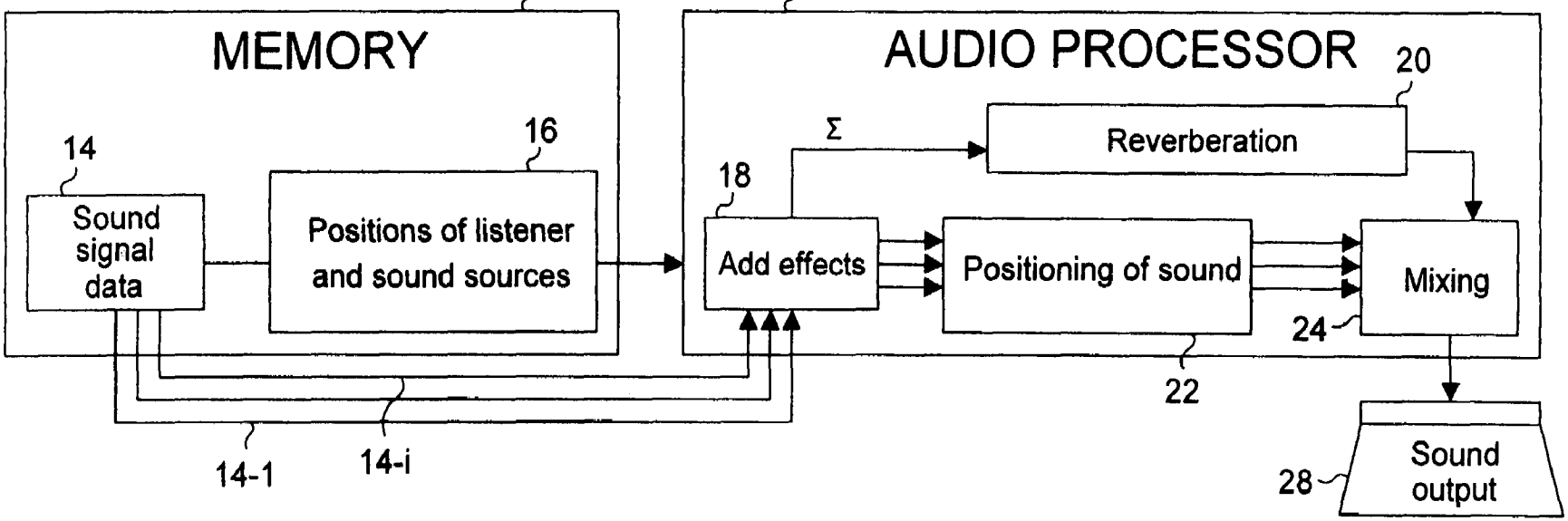
FIG. 2 shows the hardware elements in their arrangement for use for the processing of audio signals according to the prior art.

As indicated in FIG. 2, and in a known manner, the audio processor receives the data from the memory 8, i.e. each item of audio signal data represented by an arrow 14-*i* (i being a positive whole number representing one of the audio signals) and the position data of the corresponding sources and the listener position data. The audio signals are processed by the audio processor. This processing is translated by the addition of effects 18 comprising operations which must be used for each input audio signal, such as, for example, the addition of the Doppler effect, the addition of a delay, attenuation by distance, the addition of occlusion/obstruction effects, or directivity. Other effects, such as the positioning effects 22 of each source signal in the scene can be added (sounds deriving from a distant source or a source close to the listener, deriving from the direction of provenance of the sounds to the listener's ears). The audio signals are then subjected to a mixing process 24, corresponding to the summation of the signals processed in this manner. After the addition of the effects 18, the signals can be added together into one signal subject to certain effects, such as a reverberation effect. The resultant effect is added to the summation of the spatialized signals thanks to the mixing module 24, in order to obtain a final sound signal. The audio processor processes the audio signals in real time, as a function of a data item of the spatial position of a listener.

Accordingly, the audio processor 10 delivers an analogue signal transformed into sound and distributed by the loudspeaker device 28. This computer device allows for a spatialized sound return to be obtained, which improves the sense of realism and of immersion in the scene or the environment presented on the screen. Examples of known sound cards are detailed on the following Internet pages:

[1] Creative Labs Soundblaster©.http://www.soundblaster-.com

[2] Direct X homepage, ©microsoft

[3] Environmental audio extensions: EAX 2.0 Creative ©

In any event, the technique described heretofore reaches its limits when a large number of sound sources is defined in the scene. The processing of this large number of sound sources becomes impossible due to the cost of processing the large number of signals. It is interesting to note that the computer device described is in general limited to isolated sound sources. Apart from obtaining a realistic sound return from extended sound sources (i.e. not isolated, such as a train, for example), it is possible to sample the surface or the volume so as to define the source in a collection of isolated sources. A disadvantage with such an approach is that it rapidly multiplies the number of sources to be processed. A similar problem is encountered if the reflections or diffractions of the sound on the walls of the virtual environment have to be modelled in the form of "source images". This concept is presented in the following articles:

[4] J. B. Allen and D. A. Berkley, "Image method for efficiently simulating small room acoustics", Journal of the Acoustical Society of America, No. 4, Vol. 65, 1979.

[5] J. Borish, "Extension of the image model to arbitrary polyhedra", Journal of the Acoustical Society of America, No. 6, Vol. 75, 1984.

[6] N. Tsingos, T. Funkhouser, A. Ngan and I. Carlbom, "Modelling Acoustics in Virtual Environments using the Uniform Theory of Diffraction", ACM Computer Graphics, SIGGRAPH'01 Proceedings, pp. 545-552, August 2001.

A technical solution has been presented by Herder based on the regrouping of sound sources and on the selection of a fixed number of sound sources which are representative of the whole of the sound sources. The Herder technique remains expensive, however, and is not readily adaptable to a given budget. This technique is described in the following work:

[7] Jens Herder, Optimization of sound spatialization resource management through clustering, The Journal of Three Dimensional Images, 3D-Forum Society, 13(3):59-70, September 1999.

Accordingly, the invention provides a technical solution which allows for the audio-visual presentation of environments containing hundreds of sound sources at a lower cost than previous solutions. Advantageously, the invention allows for an audio-visual presentation, with reverberation and effects depending on the frequency, on large-scale public systems.

Figure 3:
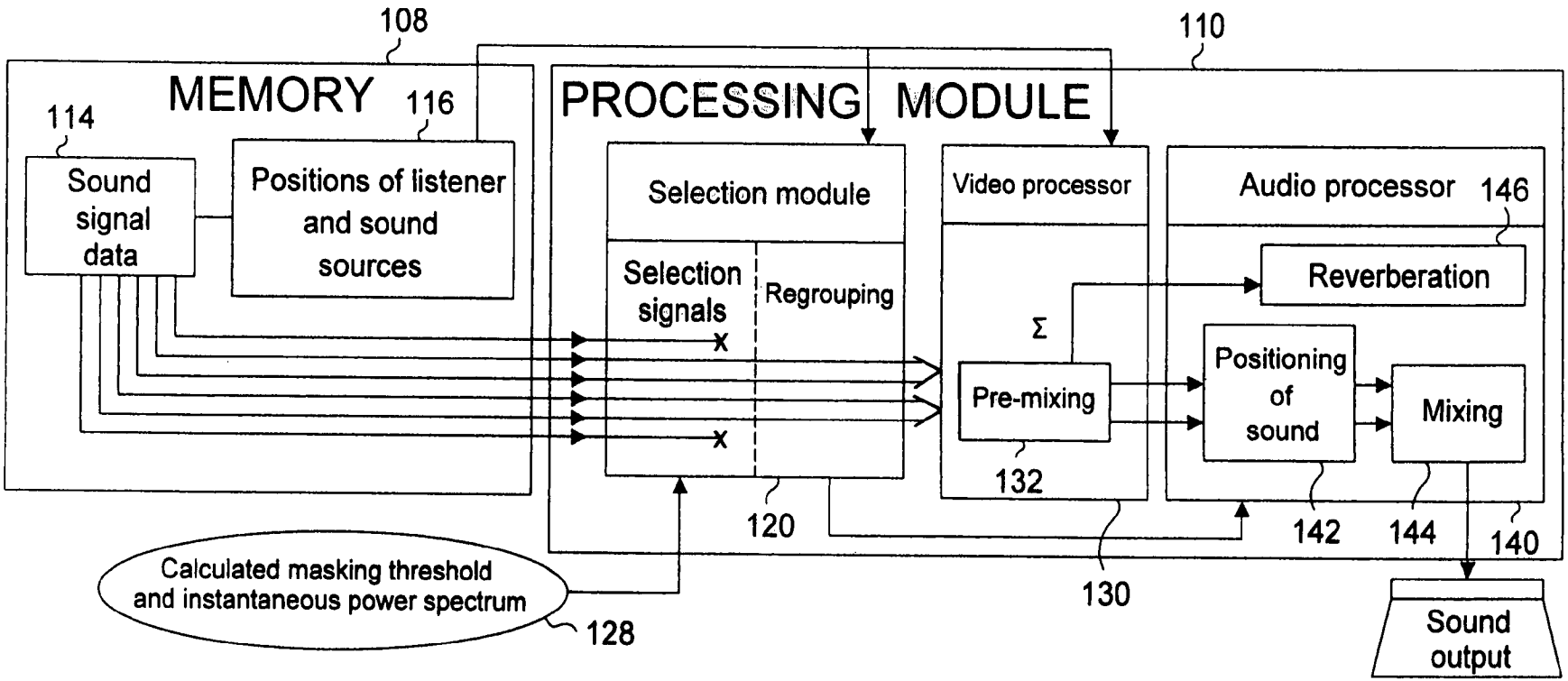
FIG. 3 shows the hardware elements in their arrangement for use for the processing of audio signals according to the invention.

One example of an embodiment of the device according to the invention is detailed in FIG. 3. The device comprises a memory 108 which allows for the data from audio signals 114 to be stored, and corresponding sound source positions, as well as the position of the listener 116. This memory operates in conjunction with a processing module 110, comprising a selection module 120, a video processor 130, and an audio processor 140. By way of example, the device applying the process according to the invention can be a computer such as a PC Xeon 1.8 GHz, comprising a sound card, which can be a Soundblaster Audigy card or a SoundMax card, and a video card, which can be a GeForce 4600T1 card or an ATI Radeon Mobility 5700 card.

Figure 4:
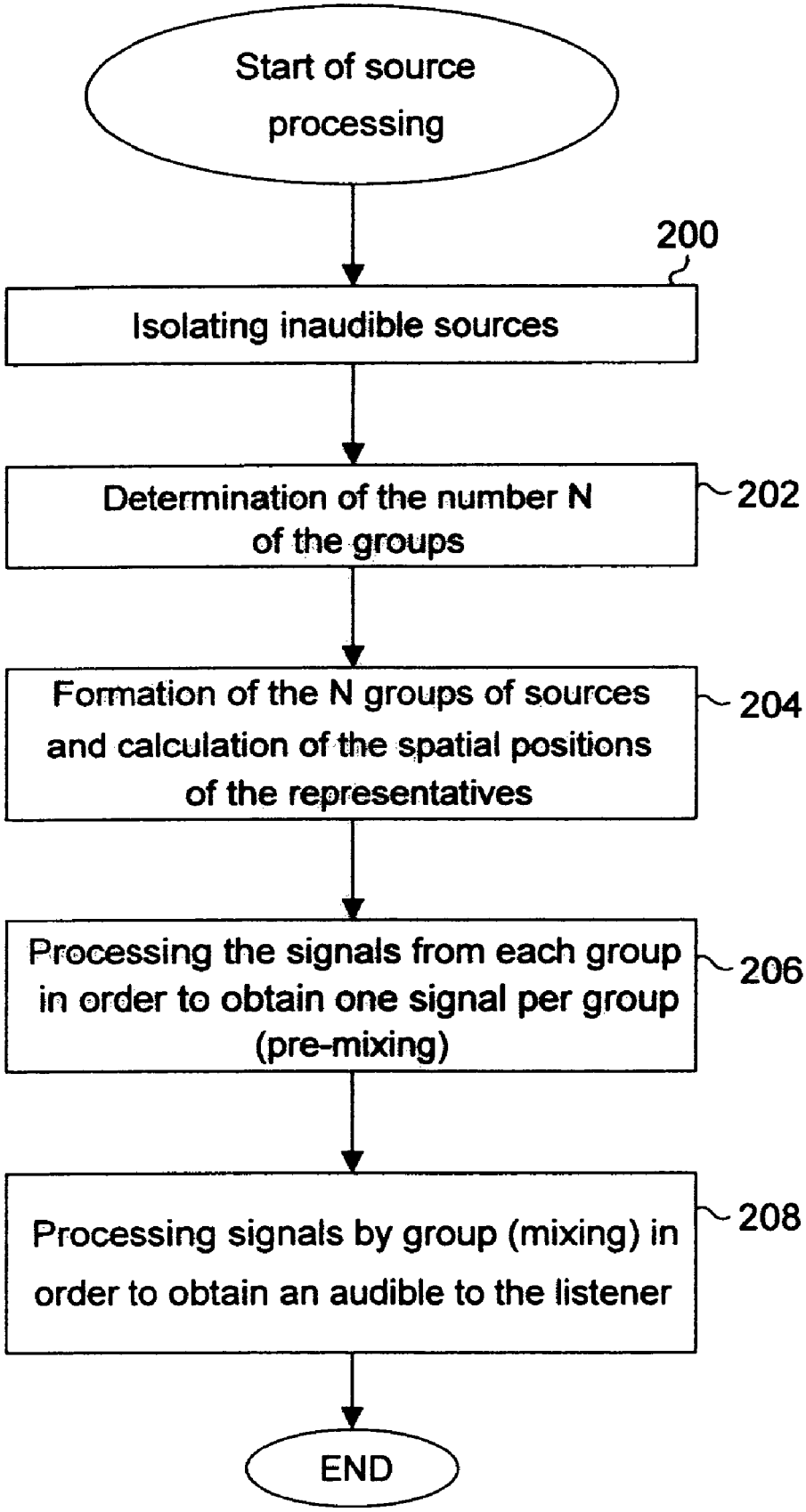
FIG. 4 is a flow chart showing the processing method of audio signals according to the invention.

The processing of the audio signals as a function of the positions of the sound sources and of the position of the listener is described in the flow chart in FIG. 4, in correspondence with FIG. 3.

Prior to the processing of the signals by the processing module, the data relating to the spectral density type of instantaneous power PSD and the masking power threshold M 128 are calculated by the processing module for each sound source position stored in the memory. Several expressions for the calculation of the masking power threshold are known from applications of perceptual audio coding (PAC), for example in the Level III (MP3) standard of MPEG-1. These expressions can be found in the following works:

[8] K. Brandenburg, MP3 and AAC explained. AES 17th International Conference on High-Quality Audio Coding, September 1999,

[9] R. Rangachar, Analysis and improvement of the MPEG-1 audio layer III algorithm at low bit-rates, Master thesis, Arizona State University, December 2001.

This calculated masking power threshold corresponds to the maximum power of a sound which can be masked by the signal. In the present invention, the masking power thresholds can be dynamically calculated for a large number of sources. Nevertheless, as the audio signal data is pre-recorded and not dynamically evaluated, the masking power thresholds M are dynamically calculated on the basis of the tonality data T (or tonality index), which can be pre-calculated and pre-recorded in 114, and are then dynamically accessible. It is then likewise possible to arrive at spectral densities of instantaneous power PSD, which allow for the tonality data T to be pre-calculated.

It is likewise possible to envisage the evaluation of the spectral densities of instantaneous power PSD in bursts, if the whole of the signal is not available in advance (for example, if the audio data is synthesised or transmitted in the form of flows, referred to as "streaming"), in such a way as to calculate the tonality data T. Reference is therefore made to signals which are partially pre-recorded. This evaluation in bursts, however, requires greater calculation power.

Solely by way of example, this data is calculated for each audio signal, and, more precisely, for three pre-calculated components of each audio signal corresponding to three frequency bands of the audible audio spectrum. The number of three frequency bands is not by any means limitative, and could be, for example, twenty five bands. These audible frequency bands are, in this example, f1=[0-500 Hz] low frequencies, f2=[500-2000 Hz] medium frequencies, and f3=[2000 Hz and above], high frequencies. The masking power thresholds M and the spectral densities of instantaneous power PSD are calculated on the basis of the techniques described in the following works:

[10] K. Brandenburg, MP3 and AAC explained. AES 17th International Conference on High-Quality Audio Coding, September 1999.

[11] E. M. Painter and A. S. Spanias. A review of algorithms for perceptual coding of digital audio signals. DSP-97, 1997.

[12] R. Rangachar, Analysis and improvement of the MPEG-1 audio layer III algorithm at low bit-rates, Master thesis, Arizona State University, December 2001.

[13] Ken Steiglitz, A DSP Primer with applications to digital audio and computer music. Addison Wesley, 1996.

For each frequency band, a Fourier transformation is calculated on the basis of the techniques from the works [8], [9], and

[14] E. M. Painter and A. S. Spanias. A review of algorithms for perceptual coding of digital audio signals. DSP-97, 1997.

For each frequency band f, the distribution of the instantaneous power spectrum PSDt(f) is calculated for each image t. For the calculation of the masking threshold M, reference is made to the equations A1 to A3 of Appendix A.

At a given instant, the selection module receives the audio signal 114, the data 128 relating to the type of the masking threshold, as well as the instantaneous power spectrum PSD. With this data, the selection module carries out a sorting process between the signals, and isolates the inaudible sources at stage 200 in FIG. 4.

To do this, the selection module estimates at the instant T the perceptive volume $L_k^T$ of the audio signal, as indicated by the equation A4, from each sound source k and for the whole of the frequency bands f. As indicated in the equation A5, this perceptive volume is a function of the power level of each frequency band f at an instant T-δ, an instant which takes account of the delay in the propagation of the signal between the position of the source and the position of the listener, and of the contribution α(f), which differs from the perceptive volume of each power level P(f). The power level of each frequency band f is calculated on the basis of the spectral distribution of the instantaneous PSD power from the source at the instant T-δ, from the attenuation A, dependent on the distance, the occlusion, and the model of directivity of the source, for example. This instantaneous perceptive volume can be averaged out over the preceding instants (such as the preceding ten instants T). The term used is "power level parameters" in order to encompass the masking power threshold and the parameters dependent on the power levels, i.e. the power levels themselves and the perceptive volumes, for example. A source is defined by its spatial position and its power level parameters calculated by the processing module 110 from FIG. 3. At every instant T the selection module 120 samples the sound sources in the descending order of the results obtained by the calculation of the criterion from the equation A6, combining the perceptive volume and the masking threshold. The criterion A6 may therefore be considered as a quantification of the perceptive importance of each source in the overall sound scene.

After having calculated the overall power level of the scene Po for the whole of the sources in A7 at a given instant, the algorithm A8 is applied at this given instant, and for each source Sk, in such a way as to select and eliminate the inaudible sources. The algorithm A8 progressively inserts the sources Sk in decreasing order of importance in the current mixing process, Pmix. The power level Pk of the source is drawn from the overall power of the scene Po, and is added to the current power from the mixing Pmix, while the masking power threshold Mk of the source is added to the current masking power threshold Tmix of the mixing. The algorithm A8 is repeated for each source Sk, such that the two following conditions are fulfilled:

1. The overall current power of the scene is greater than the difference between the current power of the mixing and the current masking power threshold of the mixing;
2. The remaining overall power is greater than the absolute threshold of hearing (ATH).

In FIG. 3, the signals are represented by arrows entering into the selection module, and the inaudible signals are represented by arrows which stop in the selection module 120 in a cross. These operations are repeated successively for each instant.

With audible sources, the selection module determines the number N of the groups of audible audio signals (or audible sources) which it is possible to achieve in stage 202.

The number N of groups can be directly predetermined by the user, and recorded and read by the selection module, for example, or can be derived from the error threshold value defined subsequently in A10, a value fixed by the user. A source group can be spatialized by using an audio channel of the sound card (DSP). The number N of groups can therefore be selected as being equal to the maximum number of channels which are capable of being spatialized by the sound card. If the spatialization, i.e. the positional processing of the sound, necessarily needs to be carried out with the aid of the central processor, an evaluation of the cost of the calculation of one group can allow the user to determine what number N of groups are to be formulated. It is likewise possible to maintain dynamically an evaluation of the cost of the calculations carried out for each group (for example, by evaluating the processor time required) and to adapt the number N of the groups in operation. This number N is therefore variable, according to the values returned by the user in accordance with the number of channels of the sound card or in accordance with the evaluation of costs, for example.

In stage 204, the selection module is capable of regrouping the audio signals into N groups. The processing module is capable of calculating a representative spatial position for each group of audio signals, as a function of the spatial position and the perceptive volume of each corresponding source.

Figure 4A:
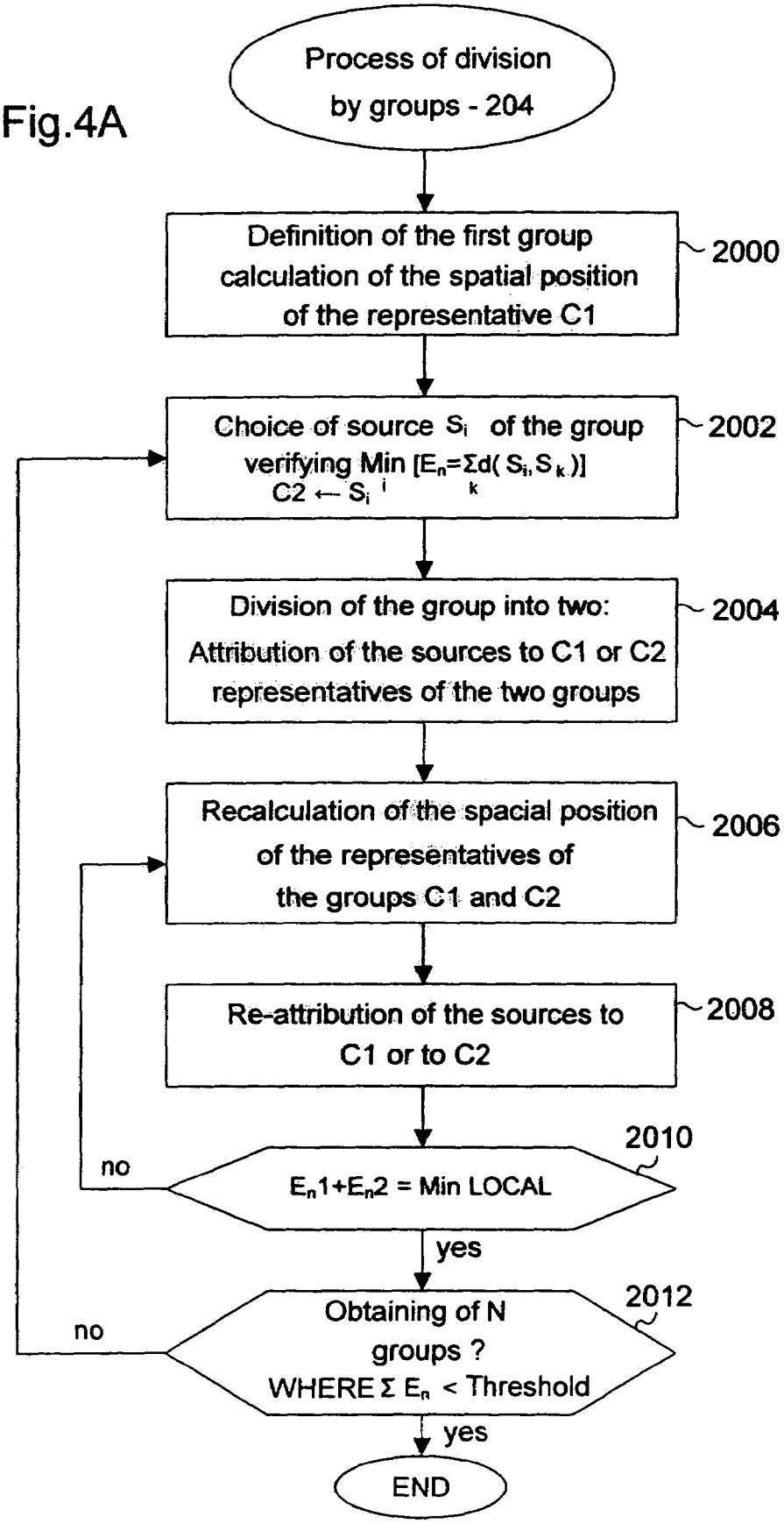
FIG. 4A is a flow chart detailing a stage of division per group of the process from FIG. 4.

The process from stage 204 will be detailed more specifically by reference to FIG. 4A hereinafter. The process from stage 204 is likewise capable of regrouping audio signals by using a process other than that detailed in reference to FIG. 4A. Accordingly, it is possible to determine the N representatives chosen from among the sources by using a rule of thumb such as is presented in the following work:

[14] Hochbaum, D. and Shmoys, D., A best possible heuristic for the k-center problem. Mathematics of Operations Research, 1985.

The N groups are accordingly formed by assigning each source to the closest representative in the meaning of the metrical arrangement defined in the equation A9 detailed hereinafter.

In stage 206, the audio signals from each group are processed in order to obtain one pre-mixing audio signal per group. The obtaining of a pre-mixing signal per group will be explained in relation to FIG. 4B, which provides details for stage 206. By reference to FIG. 3, the stage for pre-mixing the signals by group is advantageously carried out in the video processor 130 in a pre-mixing module 132. The term "pre-mixing" is understood to mean first the operations which must be carried out for each input audio signal, such as, for example, the addition of the Doppler effect, the addition of a delay, attenuation by the distance involved, occlusion/obstruction effects, or directivity, as well as the sum of the signals processed in this manner in each group. The pre-mixing process can likewise include the summation of all the signals from all the groups, in order to add a reverberation effect 146 to this summation signal (Σ). The audio processor 140 then receives an audio pre-mixing signal for each group, and the summation signal (Σ). The audio processor can add the reverberation effects 146 to the summation signal. The audio processor applies a positioning effect 142 on each pre-mixing audio signal before mixing them with one another, as well as the signal deriving from the reverberation module 146, in order to obtain a mixing audio signal which is audible to the listener at stage 208.

The term "mixing" is understood to mean, after the operations for positioning signals in the scene, the final summation of the positioning operations, and the reverberation effects, if these apply.

Stage 204 is now described in detail by reference to FIG. 4A.

In the first instance, the regrouping of the sources into groups is effected by forming a first group which comprises solely the audible sources. This group is then successively divided up in order to obtain the number of groups actually desired. In the event of the number of groups being greater than the number of sources available, each source will represent one group.

Figure 5:
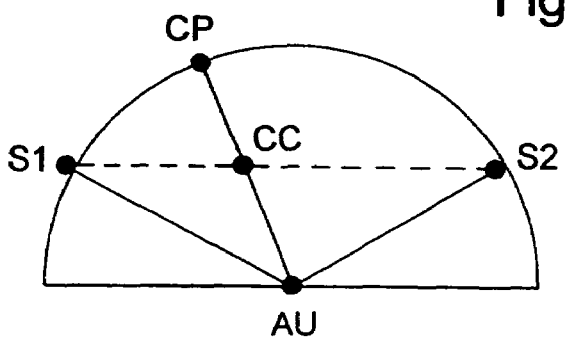
FIG. 5 represents in diagrammatic form a comparison between the use of Cartesian co-ordinates and polar co-ordinates for determining the position of a fictitious sound source replacing two real sound sources.

At stage 2000, the selection module defines a first group which contains solely the audible sources and calculates the spatial position of the representative C1 of the group. This spatial position corresponds to the evaluation of the centroid on the basis of the interplay of the spatial positions of the sources emitting the audio signals. In the example of the invention and as illustrated by FIG. 5, it is interesting to use the polar co-ordinates to define the spatial positions of the sources S1 and S2, remote from the listener, in order to determine a polar centroid CP of the representative of the group, and not a Cartesian centroid CC. In fact, the Cartesian centroid CC of the representative of the group is very close to the listener AU, and does not allow for the distance to be maintained between the sources (S1 and S2) and the listener. On the contrary, the polar centroid CP of the representative of the group preserves the distance with the listener AU, and therefore the propagation delay of the signal as far as the listener. In order to determine the spatial position of the representative C1 of the group in the manner of a barycentre, the perceptive volume of each source can be associated with its spatial co-ordinates as indicated in A11.

At stage 2002, a source Si from the group is selected, such that its data minimise an overall error function defined in A10. In effect, a representative of the group must ensure that the acoustic distortions are minimal when it is used to spatialize the signal. The function of overall error is the sum of the error distances or "error metrics" for all the sources of the group. These error distances or "error metrics" are defined in A9 as the sum of two terms of spatial deviation between a source and the representative of the group. Accordingly, stage 2002 consists of determining, on the basis of the first group of audio signals, of their corresponding sources, and of the calculated data for the spatial position of the representative C1 of the first group, a source for which the sum of the error distances calculated between the spatial position of this source and those of the other sources of the first group is minimal. C and Sk used in A9 correspond respectively to a first and second vector, in a reference centred on the current position of the listener, having as its spatial Cartesian co-ordinates respectively those of the centroid C and those of the source Sk. The two terms of the sum comprise a distance deviation term and an angle deviation term. The contribution of the perceptive volume of the source allows for a minimum error distance to be ensured for the sources which have a strong perceptive volume. By way of example only, the parameters $\gamma$ and $\beta$ can take the values 1 and 2 respectively, in order to balance the deviation terms between one another.

The source Si chosen becomes the new representative C2 of a second group which is to be formed. At stage 2004, the audio signals of the group and the corresponding sources are attributed either to the representative C1 or to the representative C2, in accordance with a given criterion. Accordingly, stage 2004 consists of attributing the audio signals of the first group and their corresponding sources to one of the spatial positions, among the calculated data of the spatial position of the representative C1 of the first group and the spatial position data of the source Si determined, as a function of the evaluations of error distance, in such a way as to form the two groups. The error distance between the spatial position of a source Sk of the group and the spatial position of the representative C1 of the group is compared to the error distance between the spatial position of the same source and the spatial position of the representative C2 (corresponding to the source Si). The minimum error distance allows for the representative to be determined to which the audio signal and the corresponding source will be attributed. More precisely, the audio signal and the corresponding source are attributed to the spatial position data of the source Si determined (corresponding to the representative C2) or of the representative C1 of the first group corresponding to the minimum error distance (2004).

Once the attribution of the audio signals and their sources to the representatives C1 or C2 has been effected, the spatial position of the representatives C1 and C2 is recalculated in accordance with A11 for optimisation in stage 2006. In stage 2008, since the representatives C1 and C2 have new spatial positions, a new attribution of the audio signals and their sources to the representatives C1 and C2 is effected in accordance with the same criterion of minimum error distance as in stage 2002. Stages 2006, i.e. the recalculation of the spatial position of the representative of each of the two groups, and 2008, i.e. the re-attribution of the sources to one or the other of the representatives of one of the two groups, are repeated until a criterion is verified at stage 2010. In the embodiment shown, the criterion of stage 2010 is that the sum of the overall errors for the representatives of the two groups attains a local minimum of the error function A10. In other words, this criterion of stage 2010 is that the sum of the error distances between the representatives of the two groups and their sources attains a minimum.

After obtaining the groups of which the representatives have optimised spatial positions in relation to the sources of each group, it is possible to re-divide one of the groups into two groups in an iterative manner (return to stage 2002). The group which is to be divided can be chosen from among all the current groups, such as, for example, that of which the error A10 is the largest. The subdivision is carried out until the desired number of groups is obtained or until the overall error, i.e. the sum of errors A10 for each group, is less than a threshold defined beforehand by the user.

Figure 4B:
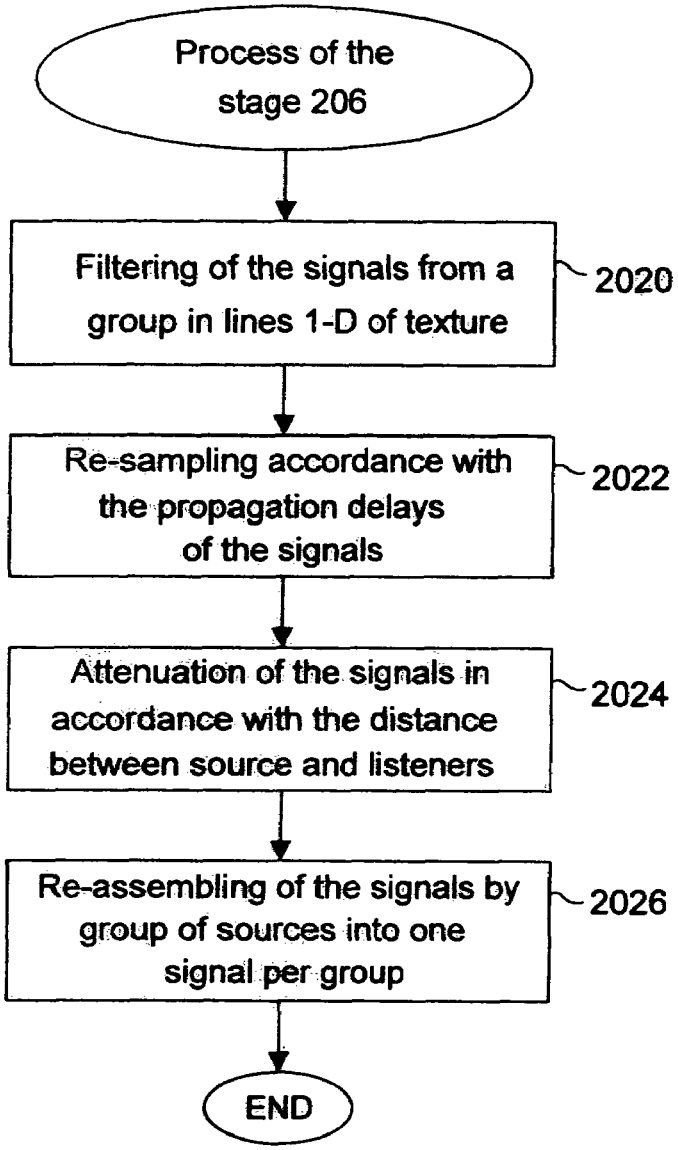
FIG. 4B is a flow chart detailing a stage of signal processing per group of the process from FIG. 4.

FIG. 4B discloses in detail stage 206 from FIG. 4. The audio signals are received in groups by the video processor. As seen beforehand and illustrated in FIG. 6, each audio signal SO1 has been broken down into three pre-calculated components R, G, B, corresponding to three frequency bands of the audible audio spectrum. Other frequency bands than those already used, however, can be used in stage 206. At stage 2020, in the video processor, these components R, G, B, are loaded into the memory in the form of a collection of textured sections 1D. Accordingly, the video signal SV1 results from the filtering of the audio signal SO1 in the form of two textured lines, one for the positive part of the signal and the other for the negative part of the signal, each line comprising a collection of textured sections. The possible textures of the sections can correspond, in a non-limitative manner, to a variation of monochromatic contrasts or to a variation from black to white, as illustrated. According to FIG. 6, for the positive line of the video signal, the more the audio signal acquires a higher value, the more the corresponding section has a light texture, and for all the negative values of the audio signal, the corresponding sections adopt the same dark texture. For the negative line of the video signal, the more the audio signal acquires a negative value of which the absolute value is higher, the more the corresponding section has a light texture, and for all the positive values of the audio signal the corresponding sections take on a dark texture, in general black.

The representation in the form of two textured lines is not limitative, and can be reduced to one line if a video memory is used which accepts the negative values of the signal.

At stage 2022, the video signal of each source is then re-sampled in order to take account of the variable from the propagation delay adopting a different value according to the placement of the source in relation to the listener. At stage 2024, the video signal from each source is likewise attenuated in accordance with the distance between the source and the listener. These stages, 2022 and 2024, of the signal modification according to the sound modification parameters, can be carried out at the same time or in an order different from that in FIG. 4B. Other sound modification parameters could be envisaged; for example, the attenuation could be a function of the frequency. FIG. 7 illustrates the re-sampling and attenuation of the signal from a source. The audio signal SO2 (function of the time) is first filtered in order to obtain a video signal SV2, in the form, for example, of two textured lines (one for the positive part of the audio signal, the other for the negative part of the audio signal), the signal forming a first assembly of textured blocks TBk and a second assembly of textured blocks TBk+1. The re-sampling of the two assemblies is carried out in order to reduce the signal propagation time as a function of the propagation delay. The signal can likewise be attenuated in accordance with an attenuation which depends on the frequency band and/or in accordance with an attenuation depending on the distance from the source to the listener, or, more precisely, an attenuation depending on the distance from the source to the listener corrected by the distance between the source and the representative of the group. By way of comparison, the audio signal SO2 and corresponding video signal SV2 are presented after temporal re-sampling and attenuation of the amplitude in FIG. 7. The audio signal SO2 is therefore compressed temporally and the amplitude of the signal is attenuated progressively as a function of the time. The operations 2022 and 2024, carried out on the video signal SV2 (corresponding to the audio signal SO2) allow for a video signal SV3 to be obtained (corresponding to the audio signal SO3), temporally compressed and attenuated progressively as a function of the time. The temporal compression of the video signal takes effect, for example, by way of a reduced width of the textured sections in order to obtain two block assemblies LS1 and LS2. The progressive attenuation as a function of the time takes effect, for example, by way of a modulation of the textures of the sections.

At stage 2026, each video signal is converted into an audio signal by first carrying out a recombination of the two video signal lines (the positive and negative parts of the signal). For each group, the audio signals are therefore reassembled into a single audio signal connected to the group of sources. The audio signal obtained per group is called the pre-mixing audio signal. FIG. 8 illustrates, for an assembly of groups of sources G1, G2, G3 and G4, and a listener L, two echograms H1 and H2 providing the quantity of energy delivered per group as a function of the time to the listener L. The first echogram H1 illustrates the case of the procedure from FIG. 4B. Accordingly, each signal from each group is the object individually of the operations 2022 and 2024 before the reassembling of the signals per group at stage 2026. This order of the stages allows for a distribution of energy to be obtained within the time for each group, while still taking into account the propagation delay and the attenuation of each signal of the group. The echogram H2 illustrates the situation in which the operations 2022 and 2024 have been carried out after the reassembling of the audio signals per group of sources, i.e. on each signal representing a group. This order of stages allows for a distribution of energy to be carried out within the time for each group, but this time by taking into account the propagation delay and the attenuation of the representative signal of the signals from the group. The order of the stages can be chosen according to the degrees of fine perception of the sounds desired by the listener. It is clear that the memory used and the calculation times will be less in the case of the histogram H2, but that the perception of the sounds by the listener will be less fine than in the case of the histogram H1.

This process can be implemented on any graphics card which speeds up the standard graphic library routines "OpenGL" or "Direct3D". The capacities of the new graphic cards at present allow work to be carried out with micro-programs executed every time a pixel is displayed ("pixel shader" or "fragment programs"). In this case, it is possible to work with signed data, and it is not necessary to separate the positive and negative parts of the signal. Moreover, in this case the operations can be carried out with extended resolution (32 bit, floating, as against 8 entire bits on older cards). Because of this, it is possible to use the same algorithm as previously in order to construct a texture of which each line corresponds to the signal SV2 of each source. The lines desired are then added up for each of the groups in a "pixel shader" micro-program, tracing a new line per group. Access to the lines wanted and their addition is carried out in the "pixel shader" program.

Each pre-mixing audio signal is connected to the representative of a group which represents a fictitious source. These pre-mixing audio signals can be used by a standard spatialized audio system in order to render audible the sources from the scene being shown. By way of example, spatialization can be effected by software or by a standard programming interface for the audio output from games, such as Direct Sound. In this latter case, a 3D audio buffer memory can be created in order to store the pre-mixing signal from each group. Each pre-mixing signal is then positioned at the co-ordinates of the representative of its group, for example by using the command SetPosition of the Direct Sound programming interface. Other means of processing, such as that of artificial reverberation, can likewise be used if proposed by the standard spatialized audio system being used.

The approach described introduces three principal stages, using a perceptive elimination of the inaudible sound sources, a regrouping process allowing for a large number of sources to be output on a limited number of cabled audio channels, and the graphics hardware to carry out the pre-mixing operations required.

With little effect on the graphic performance, the method and associated device allow for the material resources of existing sound cards to be exploited, while introducing additional possibilities of control and processing.

The implementation of the method described by an appropriate device allows for an audio-visual output of quality to be obtained for a complex virtual environment comprising hundreds of mobile sources, personages, and animated objects.

The invention could equally be applied to a computer device comprising a mother card, which in turn comprises a video processor or a video card and an audio processor or a sound card.

Appendix 1

$$SFM_i(f) = 10\,\mathrm{log10}\left(\frac{\mu_g(PSD_x(f))}{\mu_a(PSD_1(f))}\right), \quad \text{A1}$$

$$T_i(f) = \frac{\max(SFM_i(f), 0)}{-60} - 1. \quad \text{A2}$$

$$M_c(f) = 31 * T_i(f) + 12 * (1 - T_i(f)), \quad \text{A3}$$

-continued $$L_i^T = \sum_f \alpha(f) P_k^{T-\delta}(f), \quad \text{A4}$$

$$P_k^{T-\delta}(f) = PSD_k^{T-\delta}(f) \times A_k^T(f)/r^2, \quad \text{A5}$$

$$L_k^T \| 60 - M_k^{T-\delta} \| \quad \text{A6}$$

$$P_{TOT} = \sum_k P_k^{T-\delta}(f). \quad \text{A7}$$

$$\begin{aligned} & P_0 = P_{TOT} \\ & \text{while } P_0 > P_{matx} - T_{fl} : x \\ & \quad \text{and } P_0 > ATH \text{ do} \\ & \quad \text{add source } S_k \\ & \quad P_0 -= P_k \\ & \quad P_{mix} += P_k \\ & \quad T_{\min}^{+} = M_k \\ & \text{end} \end{aligned} \quad \text{A8}$$

$$d(C, S_k) = L_k^T \left( \beta \log_{10}(\|C\| / \|S_k\|) + \gamma \frac{1}{2}(1 + C.S_k) \right), \quad \text{A9}$$

$$E_n = \sum_j d(C, S_j) \quad \text{A10}$$

$$pc = \sum_j L_j^T r_j \Big/ \left( \sum_k L_k^T \right), \quad \text{A11}$$

$$\theta_c = \theta \left( \sum_j L_j^T S_j \Big/ \left( \sum_k L_k^T \right) \right),$$

$$\phi_c = \phi \left( \sum_j L_j^T S_j \Big/ \left( \sum_k L_k^T \right) \right).$$

Appendix 2

C: Representative of a group—by extension in the mathematical formulae, vector of the spatial co-ordinates of the representative of a group Sk: Sound source in a virtual scene—by extension in the mathematical formulae, vector of the spatial co-ordinates of the sound source $L_k^T$: Perceptive volume of an audio signal from a sound source Sk at an instant T α(f): Weight controlling the relative perceptive importance of a given frequency band f f: Frequency band of an audio signal $P_k^{T-\delta}(f)$: Estimation of the power level of each frequency band f of the audio signal of a sound source K at an instant T-δ

δ: Propagation delay of the audio signal r: Distance between sound source and listener c: Speed of sound $A_k^T(f)$: Attenuation dependent on the frequency and resulting in particular from the distance and direction of the source $PSDk^{T-\delta}$: Instantaneous distribution of the power spectrum ATH: Absolute threshold of hearing Ptot: Total power level of the scene SFMt(f): Measurement of spectral oblate μg: Geometric mean of the PSD on all the frequencies μa: Arithmetic mean of the PSD on all the frequencies Tt(f): Tonality index, sound level of a signal Mt(f): Masking threshold (in dB)

Pmix: Current power of the mixing process

What is claimed is:

1. A computer device comprising:

A memory (8, 108), capable of storing audio signals (14, 114) in part pre-recorded, each corresponding to a source defined by spatial position data (16, 116), and a processing module (10, 110) to process these signals in real time as a function of the spatial position data, characterised in that the processing module (110) is capable of calculating instantaneous power level parameters on the basis of the audio signals (14), the corresponding sources being defined by said parameters of the instantaneous power level, in that the processing module (110) comprises a selection module (120) capable of grouping together certain of the audio signals into a variable number of audio signal groups, and that the processing module (110) is capable of calculating representative spatial position data of a group of audio signals as a function of the spatial position data (116) and the parameters of the instantaneous power levels of each corresponding source in order to obtain a mixing signal which is audible to a listener.

2. A computer device according to claim 1, characterised in that the selection module (120) is capable, prior to the formation of the audio signal groups, of selecting inaudible audio signals as a function of the parameters of the instantaneous power levels, comprising a power level $Pk^{T-\delta}(f)$) and a masking threshold (Mt(f)) for each source, and of preserving audible audio signals only.

3. A computer device according to claim 2, characterised in that the parameters of the power level are calculated for each source on the basis of an instantaneous power spectral density (PSD), pre-calculated on the basis of the audio signals in part prerecorded.

4. A computer device according to claim 1, characterised in that the processing module (110) is capable of processing each group of audio signals into one pre-mixing audio signal, and of re-assembling the pre-mixing audio signals in order to obtain a mixing signal which is audible to a listener.

5. A computer device according to claim 1, characterised in that the processing module (110) comprises a video processor (130) capable of transforming the group of audio signals into a group of textured video signals, of processing each textured video signal of the group according to sound modification parameters, and of reassembling and transforming the signals from the group into one pre-mixing audio signal.

6. A computer device according to claim 5, characterised in that the sound modification parameters comprise a sound attenuation parameter and/or a sound propagation delay parameter.

7. A computer device according to claim 1, characterised in that the selection module (120) is capable of forming on the basis of a first group of audio signals and calculated group spatial position data, two groups of audio signals and of calculating the spatial position data of a representative of each of these two groups.

8. A computer device according to claim 7, characterised in that the selection module (120) is capable of determining, on the basis of the first group of audio signals, their corresponding sources and calculated data of the spatial position of the representative of the first group, a source for which the sum of the calculated error distances between the spatial position of this source and those of the other sources of the group is minimal, and of attributing the audio signals from the first group and their corresponding sources to one of the spatial positions among the calculated spatial position data of the representative of the first group and the spatial position of the source which has been determined, as a function of evaluations of error distance, in such a way as to form two groups.

9. A computer device according to claim 8, characterised in that the selection module is capable of carrying out an error distance evaluation for an audio signal from the first group and its corresponding source, consisting of the evaluation on the one hand of the error distance between the spatial position data of this source and the calculated data of the spatial position of the representative of the first group, and, on the other, the error distance between the spatial position data of this source and the spatial position data of the source which has been determined, then of evaluating the minimum distance between them, the selection module being capable of attributing the audio signal and its corresponding source to the spatial position data of the source which has been determined or of the representative of the first group corresponding to the minimum error distance.

10. A computer device according to claim 7, characterised in that the spatial position data of the source which has been determined corresponds to the spatial position data of the representative of the second group.

11. A computer device according to claim 7, characterised in that the selection module (120) is capable of calculating the spatial position data of each group representative as a function of power level parameters of each source attributed to the group.

12. A computer device according to claim 7, characterised in that the selection module (120) is capable of calculating the spatial position data of the representative of each of the two groups, by determining a source for which the sum of the error distances between the spatial position of this source and those of the other sources of the group is minimal, and the selection module (120) is also capable of re-attributing the sources to one or the other of the representatives of one of the two groups as a function of an evaluation of the minimum error distance.

13. A computer device according to claim 12, characterised in that the selection module (120) is capable of recalculating the spatial position data of the representatives of each of the two groups and of re-attributing the sources to one or the other of the representatives of the two groups until the sum of the error distances between the representatives of the two groups and their sources attain a minimum.

14. A computer device according to claim 7, characterised in that the selection module (120) is capable of dividing a group until a predetermined number of groups is obtained or until the sum of the error distances between the representatives of the groups and their sources attains a predetermined threshold.

15. A method of processing audio signals in part prerecorded, each corresponding to one source, comprising stages consisting of:

a. Calculating instantaneous power level parameters on the basis of audio signals, corresponding sources being defined by these parameters and by spatial position data;

b. Regrouping certain of the audio signals into a variable number of audio signal groups and calculating spatial position data representatives of each group of audio signals as a function of the spatial position data and the instantaneous power level parameters of each corresponding source (204);

c. Processing these audio signals per said group, in real time, as a function of the spatial position data representative of the group (206, 208) in order to obtain a mixing signal, which is audible to a listener.

16. A method according to claim 15, characterised in that the stage a. additionally comprises the selection of inaudible audio signals as a function of the instantaneous power level parameters, comprising a power level and a masking threshold for each source and preserving audible audio signals only (200).

17. A method according to claim 16, characterised in that the power level parameters are calculated for each source on the basis of an instantaneous power spectral density, precalculated on the basis of the audio signals, which are in part pre-recorded.

18. A method according to claim 15, characterised in that the stage c. consists of:

c1. Processing each group of audio signals into one pre-mixing audio signal (206);

c2. Re-assembling the pre-mixing audio signals in order to obtain a mixing signal, which is audible to a listener (208).

19. A method according to claim 18, characterised in that the stage c1. additionally consists of transforming a group of audio signals into a group of textured video signals by making use of a video processor (2020), of processing each textured video signal of the group according to sound modification parameters (2022, 2024), and of re-assembling and transforming the group signals into one pre-mixing audio signal (2026).

20. A method according to claim 19, characterised in that the sound modification parameters comprise a sound attenuation parameter and/or a sound propagation delay parameter.

21. A method according to claim 15, characterised in that the stage b. additionally consists of forming, on the basis of a first group of audio signals and calculated spatial position data of the group (2000), two groups of audio signals, and of calculating the spatial position data of a representative of each of these two groups (2002 to 2012).

22. A method according to claim 21, characterised in that the stage b. additionally consists of determining, on the basis of the first group of audio signals, their corresponding sources, and calculated data of the spatial position of the representative of the first group, a source for which the sum of error distances calculated between the spatial position of this source and those of other sources of the first group is minimal (2002), and of attributing the audio signals of the first group and their corresponding sources to one of the spatial positions, among the calculated data of the spatial position of the representative of the first group and the spatial position data of the source which has been determined, as a function of the evaluation of the error distance, in such a way as to form two groups (2004).

23. A method according to claim 22, characterised in that the distance evaluation from stage b. consists, for an audio signal of the first group and its corresponding source, of evaluating on the one hand the error distance between the spatial position data of this source and the calculated data of the spatial position of the representative of the first group (A9) and, on the other, the error distance between the spatial position data of this source and the spatial position data of the source which has been determined, then of evaluating the minimum error distance between the two, and of attributing the audio signal and its corresponding source to the spatial position data of the source which has been determined or of the representative of the first group corresponding to the minimum error distance (2004).

24. A method according to claim 21, characterised in that the spatial position data of the source which has been determined from stage b. corresponds to the spatial position data of the representative of the second group.

25. A method according to claim 21, characterised in that stage b. consists likewise of re-calculating the spatial position data of the representative of each of these two groups (2006) and of re-attributing the sources to one or the other of the two groups (2008), until the sum of the error distances between the representatives of the two groups and their sources attains a minimum (2010).

26. A method according to claim 21, characterised in that stage b. consists of dividing a group until a predetermined number of groups is obtained or until the sum of the error distances between the representatives of the groups and their sources attains a predetermined threshold (2012).

* * * * *